US006238175B1

(12) United States Patent
Götz et al.

(10) Patent No.: US 6,238,175 B1
(45) Date of Patent: May 29, 2001

(54) DESTACKING APPARATUS

(75) Inventors: Wolfgang Götz, Krefeld; Guido Schrömges, Nettetal; Eggert de Weldige, Krefeld, all of (DE)

(73) Assignee: G. Siempelkamp GmbH & Co., Krefeld (DE)

( * ) Notice: Subject to any disclaimer, the term of this patent is extended or adjusted under 35 U.S.C. 154(b) by 0 days.

(21) Appl. No.: 09/388,814

(22) Filed: Sep. 1, 1999

(30) Foreign Application Priority Data

Sep. 2, 1998 (DE) ..... 198 39 924

(51) Int. Cl.[7] ..... B65B 57/30

(52) U.S. Cl. ..... 414/795; 414/786.5; 414/272; 414/797; 198/435; 271/9.07

(58) Field of Search ..... 198/435; 271/9.02, 271/9.04, 9.07, 241, 225, 11, 107, 194; 414/795.2, 796.5, 272, 795, 797

(56) References Cited

U.S. PATENT DOCUMENTS 5,078,255 * 1/1992 Haley ..... 198/358

5,692,593 * 12/1997 Ueno et al. ..... 198/369.2

FOREIGN PATENT DOCUMENTS 34 18 258 11/1985 (DE) .

* cited by examiner

*Primary Examiner*—Joseph A. Fischetti
(74) *Attorney, Agent, or Firm*—Herbert Dubno

(57) ABSTRACT

Foil sheets are removed from two stacks located one above the other on a stack rack by a swingable transfer assembly having a transfer platform along the sides of which guide rails carry a suction beam which, as the transfer assembly is swung up and down, can engage the uppermost foil sheet on one or the other stack. The suction beam draws the foil sheets onto the transfer platform where the foil sheet is oriented or aligned and from which the foil sheet is drawn onto a deposition station which can have belts carrying the laminate or in a direction orthogonal to the destacking transfer direction.

16 Claims, 7 Drawing Sheets

FIG. 8
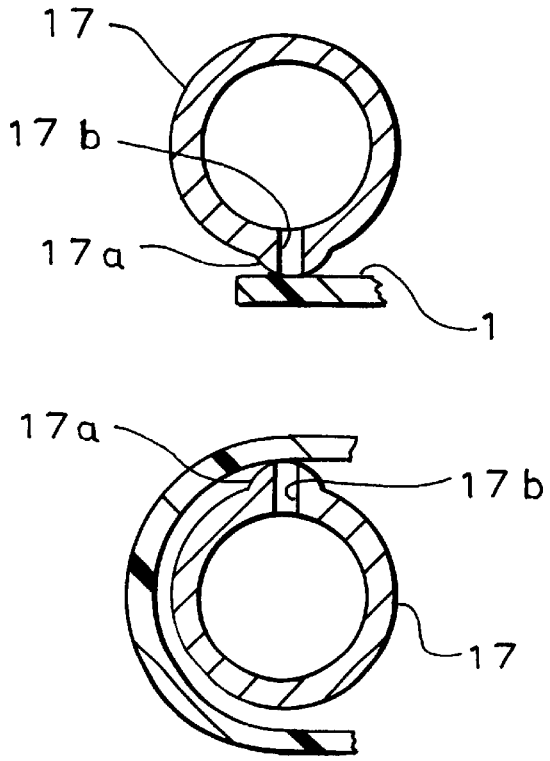
FIG. 9
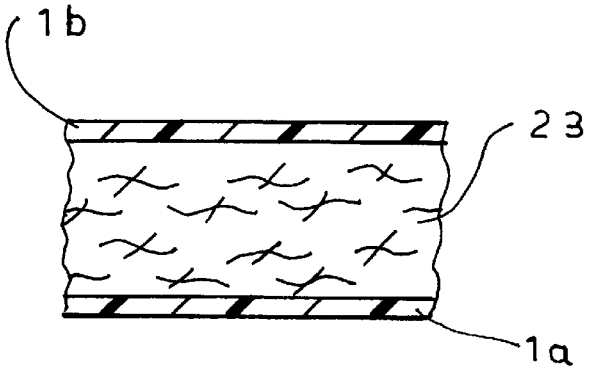
FIG. 7
FIG. 10
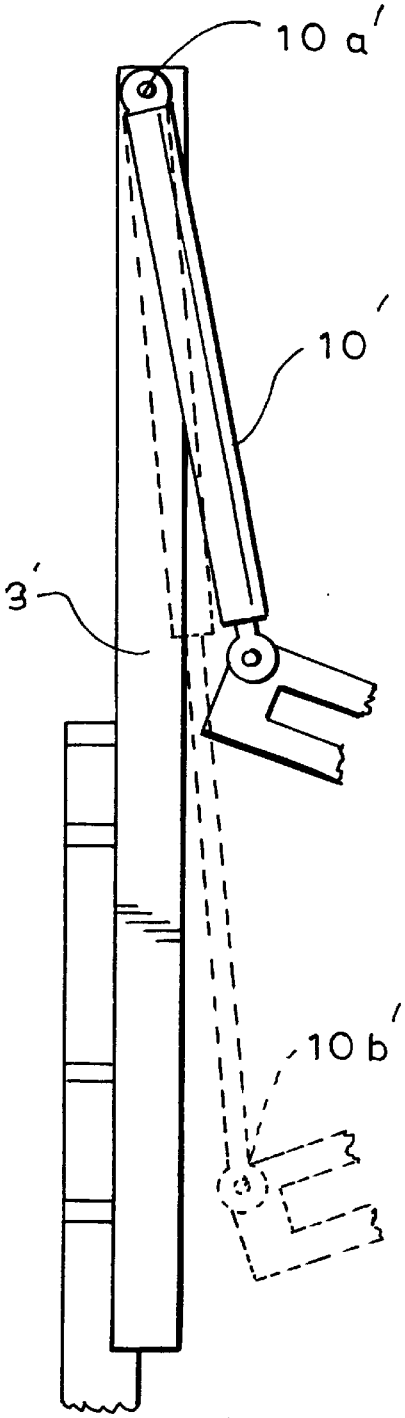

DESTACKING APPARATUS

FIELD OF THE INVENTION

Our present invention relates to a destacking apparatus and, more particularly, to an apparatus for removing individual foil sheets from a foil stack at a stack station and depositing the destacked foil sheets at a deposition station. More particularly, the invention relates to a destacking apparatus of this type in which a transfer station is provided between the stack station and the deposition station and has a suction beam which can pick up a foil sheet and which is vertically shiftable, for example, between stacks at the stack station.

BACKGROUND OF THE INVENTION

When it is desired to apply a foil to compressed board or other substrate, which itself may be a laminate, for subsequent pressing of the resulting stack in a laminating press which can consolidate the substrate in the case of pressed board, the foil layer is generally drawn from a stack and transferred to a deposition station for application to the charge to be laminated with that foil before the resulting unit is fed to the press.

In such systems, a stack station can be provided with one or more stacks of the foil layers, hereinafter referred to as foil sheets, foils or, simply sheets, and the stacks of such foils are generally provided in vertically-spaced relationship, i.e. at a distance one above another.

Between the stack station and the deposition station, a suction beam is displaceable for removing a foil sheet from one of the stacks and depositing it upon the deposition station.

The suction beam can usually be swingable vertically to the height of the respective stack sheet so that it can withdraw the foil from one or another of the stacks thereof.

Between the stack station and the deposition station, a transfer platform can be provided.

The foil can be used as the outer foil or patterning, coloring or finishing member of a construction laminate, such as pressed board, especially chip board, fiber board or the like and can be the outermost layer for a paper stack or can be composed of paper, plastic-coated paper or the like which is printed or otherwise decorated. The pressed product is broadly referred to as a laminate and more than one foil can form part of the laminate. The foils, when laminated together, may be stacked in the same direction or in opposite or alternately transverse directions.

The earlier apparatus for this purpose provides between a stack station and the deposition station, a transport carriage for the suction beam and mounts the transport carriage on a rocker which can be swingable by a piston and cylinder arrangement.

Usually a plurality of servomotors and measuring and control devices are required to align the suction beam with a foil to be picked up and frequently spindle-type drives are required for positioning the suction beam. Reference may be had to German patent document DE 34 18 258.

For a number of reasons, these systems have been found to be excessively complex and costly both to make and operate. In addition, the reliability of such systems may require improvement and the output of the system may be insufficient for mass production purposes.

OBJECTS OF THE INVENTION

It is, therefore, the principal object of the present invention to provide an apparatus for the destacking of foils and the deposition of the destacked foils at a deposition station which is simpler than earlier systems, of lighter weight and of greater reliability and precision with respect to the orientations and alignments of the destacked sheets, has reduced mass of the moving parts and greater speed of the suction beam than can be attained with earlier systems.

It is, more specifically, an object of this invention, therefore, to provide a destacking apparatus and a laminate-building apparatus utilizing the destacked foil sheets which is free from the drawbacks of earlier systems and has, therefore, higher reliability and productivity than the systems known to date.

Still another object of this invention is to provide a destacking arrangement which minimizes the mass which must be raised and lowered and reciprocated to remove individual foil sheets from a stack of such foils and carry them onto the deposition station.

SUMMARY OF THE INVENTION

These objects and others which will become apparent hereinafter are attained, in accordance with the invention, in a destacking apparatus which comprises:

- a stack station provided with means for holding at least one stack of foil sheets;
- a deposition station horizontally spaced from the stack station and provided with holding means for receiving foil sheets; and
- a transfer station between the stack station and the deposition station, the transfer station comprising:
  - a transfer platform extending between the deposition station and the stack station,
  - a pair of guide rails flanking the transfer platform,
  - a suction beam extending between the guide rails and displaceable thereon back and forth between the stations for withdrawing a foil sheet from the stack onto the transfer platform and along the transfer platform to the deposition station,
  - means forming a pivot axis for the transfer platform, the guide rails and the suction beam at a downstream side of the transfer station and at a side of the deposition station adjoining the transfer station for enabling upward and downward swinging of an upstream side of the transfer station relative to the stacking station and relative vertical displacement of the suction beam and the holding means.

More particularly, the invention provides a destacker in which the transfer platform is flanked by guide rails with drives for the suction beam and which spans across the guide rails transversely thereto, i.e. across the full width of the platform and which is displaceable back and forth on the guide rails across the length of the platform, i.e. from one side to the other thereof in the direction of displacement of the foil sheets during the destacking movement.

According to the invention, moreover, the suction beam, which engages the foil sheet, the guide rails and the platform together form a swingable unit which is displaceable about an axis along the downstream side of the platform and preferably on the deposition station, located in a horizontal plane which is between the stacks of foil sheets and from which the foil sheets can be selectably withdrawn by positioning of the beam adjacent one or the other of the stacks. As a consequence, the assembly can be swung upwardly and downwardly in the cadence of withdrawal of the foil sheets from the stacks to withdraw a foil sheet first from one stack and then from the other so that the suction beam can withdraw the foil sheets uniformly from the respective stacks and can compensate, by the different angular positions, for the varying stack heights.

The withdrawal of the foil sheets, therefore, does not require that the stack station be raised and lowered or that the individual stacks be raised and lowered on a rack or the like. The simple swinging upwardly and downwardly of the assembly formed by the platform, the guide rails and the beam with the application of suction to the suction orifices or nozzles of the suction beam allows the foil sheets to be individually withdrawn from the different stacks.

The alignment of the foil sheet can be effected on the transfer platform utilizing stationary sensors and control systems, i.e. sensors and control systems carried by the platform and thus not moveable with respect to the latter. The alignment can involve rotation of the foil sheet on the platform or angular displacement at each corner or edge of the foil sheet by effectors, for example, piston-and-cylinder units which can be disposed at angles to one another at one or more locations engageable with the foil sheet.

The alignment or positioning of the foil sheet is thus maintained when the foil sheet is fed to the deposition station where it can be laid upon another body to form the laminate stack which can be pressed as described above.

To the extent that only two foil stacks are used, the foil stacks can be mounted at a predetermined spacing one above the other and the pivot axis for the assembly is then preferably located in a median horizontal plane between the foil stacks so that the assembly is swung substantially in equal angular distances to either side of the median plane and hence the pivot movement is limited. Preferably at the upstream side of the assembly, a setting or servo unit is provided which can be mounted on the stack station and can effect the pivotal movement of the platform, guide rails and suction beam between the stacking stations. This swinging displacement can be provided by a cable or chain construction, utilizing a windlass or wheel on the frame of the stack station or piston-and-cylinder units, preferably synchronized cylinders, between the assembly and the stack station.

According to another feature of the invention the stack station has a fixed frame or rack with shelves or the like for receiving the respective stacks and of adjustable height on the rack or frame, these shelves being accessible to the suction beam.

As has been noted, the transfer platform is provided with means for orienting or aligning the foil sheets and advantageously can be formed with or as an alignment table which can be swingable at all sides in the table plane or is otherwise adjustable or orient the foil sheet and can, if desired, be rotatable. According to the invention, the table can have one or more setting units, preferably at angles to one another for orienting the table in its plane and preferably also a rotary drive for the table. These units can be piston-and-cylinder units.

The table plate can be provided with light curtains or other position sensors for detecting one or more edges of the foil and, to the extent that the foil may be a decorative sheet and can have printed alignment markings or distinctive patterns which can be detected, the sensors may be optical means. Such patterns may include contrasting strips. The effectors are operated by these sensors to properly orient the foil sheets before they are transferred to the deposition station. In some cases the contrast between the decor and background may be sufficiently pronounced that the orientation of the decor print can serve for orientation and alignment. If, for example, a foil is drawn by the suction beam onto the alignment table, the suction beam can then remain stationary and can deposit the foil sheet on the alignment table at the moment the leading edge of the foil interrupts a light beam of a light-curtain sensor. The plate is then rotated or swung until a second light beam or light curtain is interrupted to signal proper orientation of the foil sheet for transfer to the deposition station. The direction of rotation or angular displacement can be given by the output signal from the light curtain. When the second light curtain is not interrupted in a proper timing pattern, the table must be swung in the opposite sense until the plane of the light beam is interrupted by the foil edge. Thus the foil may be rotated in either the clockwise or counterclockwise sense. Upon conclusion of the rotary movement, the leading edge of the foil lies parallel to the apparatus edges. One or more sensors can thus be built into the alignment table to detect the position of the foil edge relative to the longitudinal axis of the apparatus. A control unit can register this value and store it.

When a foil is withdrawn from the other foil stack during the next destacking operation, the table of the orientating apparatus can be repositioned for the new foil and can be swung into such an orientation that the new foil sheet is properly aligned. In each case the suction beam can return to a pick-up position while the foil sheet is positioned or aligned. The orientation system can be connected to a computer which can control the setting units and the rotary drive and can receive inputs from the light curtains and sensors to ensure a high orientation precision.

A sensor and control system which is stationary at least relative to the platform and thus does not move with the beam, allows reduction of mass of the elements which must be displaceable with the greatest speed.

The table can have suction passages integrated therein and connected to a suction source so that the foil can, if necessary, be held securely against the table. The suction beam is preferably pivotally mounted on a traverse bridging the two guide rails and can be swingable into various angular positions for proper setting of the suction beam on the foil in the various levels of the uppermost foil of each stack. The suction beam is preferably mounted via slides in the guide rails, the slides being driven by electric motors, e.g. linear motors preferably synchronously.

The deposition station according to the invention can be provided with a second suction beam which can sweep at least over part of the transfer platform and the alignment table to pick up the foil deposited thereon by the first suction beam and carry it to the deposition station. The second suction beam can be displaceable on a pair of guide rails which can extend parallel to the first guide rail and which reach over part of the width or over the total width of the alignment table in a direction toward the stacking station. The second suction beam, like the first suction beam, can be pivotally mounted or connected to a traverse bridging the second guide rail and can be pivotable by means of a setting unit to allow angular orientation of the second suction beam to be varied for optimum pick up and deposition of the foil. Preferably at least the second suction pump is rotatable through about 180° so that the suction nozzles or orifices can be turned downwardly to pick up a foil and then rotated through 180° so that the suction orifices are turned upwardly. In the latter case, a reversal of the foil is possible in depositing it upon the deposition station.

According to another feature of the invention, the first suction beam can be displaced back into its pick-up position while the second suction beam is in a waiting position over the deposition station and then is shifted over the platform to receive a foil therefrom. The second suction beam can then be moved toward and over the deposition station while the first suction beam carries the next foil onto the platform. The first suction beam can also be rotatable through 180° on its traverse. The second suction beam can be raised from and lowered toward the platform once the foil has been engaged and for engagement of the foil respectively.

It has been found to be advantageous, in accordance with the invention to provide telescoping guide units for the first and/or second suction beam and to provide for the second suction beam a lifting and lowering mechanism, i.e. a mechanism for vertically displacing it to facilitate turning of the foil sheet and to accommodate different thicknesses of foils and laminates.

The second suction beam can be equipped with an electrostatic charging device which can be displaceable in the destacking transport direction beyond the front station end of the deposition station. This charging device can include, for example, rod or corona electrodes which can serve to electrostatically charge the foil in the vicinity of its leading edge and, if desired, rearwardly therefrom so that the foil can adhere by electrostatic charge to the board or stack to which it is to be laminated and will not lift from the stack as the latter is transported away from the deposition station. During the return travel of the second suction pump, from the opposite side of the deposition station, a raw board, i.e. an unlaminated or uncoated chip board, fiber board or other board composed of wood material can be placed on the deposition station. This board can be centered relative to the apparatus longitudinal and transverse axes positively so that the correctly aligned foil can be deposited accurately thereon and formation of the laminate structures can be carried out with high precision and reproducibility. So that the edges of the foil can coincide with the edges of the raw board, the foil can be moved back or forth in the deposition station through at least a limited amount.

The deposition station can be provided with or as a belt conveyor with one or more belts, preferably displaceable orthogonal to the destacking direction. The positioning of the foil or boards at the deposition station can be carried out in addition or alternatively to the alignment previously described and only when correction of the position may be necessary with respect to one or another orientation. The direction and length of the back and forth movement described can be carried out based upon a previous measurement of the position of the transverse foil edge relative to the longitudinal axis of the apparatus.

According to the invention, a lower foil can be positioned first at the deposition station, a raw board deposited thereon and an upper foil applied and oriented on the board before the resulting stack is transported by the belt conveyor to the laminating press. The direction of travel and the degree of travel for each of the members can be based upon measured positions of the foil edges by the sensor system.

It is also possible, in accordance with the invention, to carry out correction of the angular position of each foil sheet only on the alignment table or to properly align one edge on the alignment table while further alignment is effected on the transfer of the foil to the deposition station and based upon the transverse shifting of the stack via the conveyor system described. As a result, the foils can always be positioned with edge to edge accuracy on the board or relative to the board or with a desired amount of overhang at opposite board edges. Foil losses are reduced, product yields are increased and the coating of raw board is greatly simplified since there is less need for trimming.

BRIEF DESCRIPTION OF THE DRAWING

The above and other objects, features, and advantages will become more readily apparent from the following description, reference being made to the accompanying drawing in which:

FIG. 7 is a cross sectional view through a laminated stack with exaggerated thicknesses of the members thereof;

FIG. 8 is a cross section through one of the boards showing one angular orientation thereof;

FIG. 9 is a cross section through a beam showing another angular orientation; and FIG. 10 is a diagram illustrating another unit for raising and lowering the transfer platform assembly of the invention.

SPECIFIC DESCRIPTION

Figure 1:
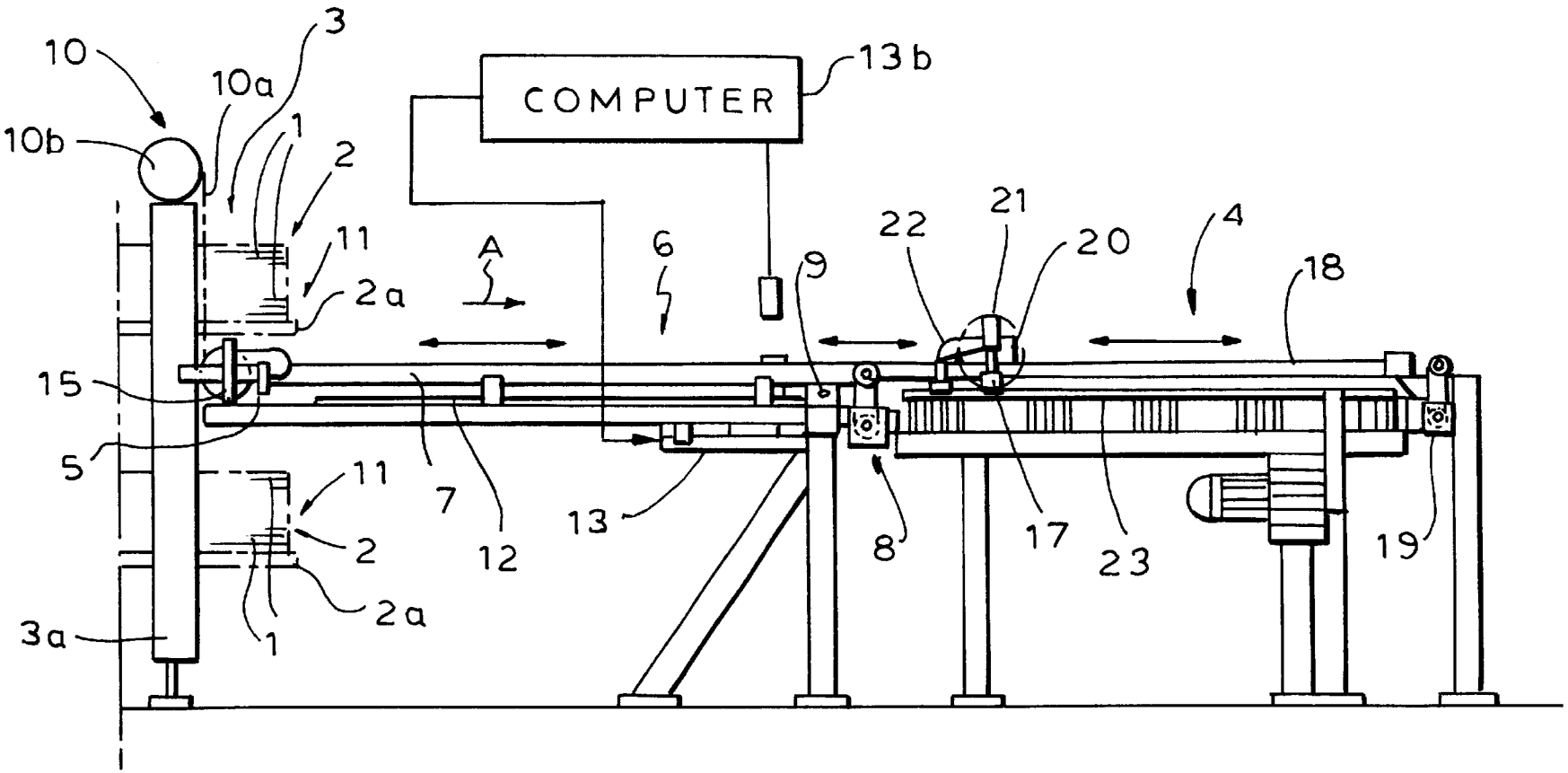
FIG. 1 is a diagrammatic side elevational view of the apparatus of the invention in simplified form.

The drawing shows an apparatus for the destacking of foils or foil sheets 1 from respective stacks 2 in a stack station 3 and the depositing of the foil sheets 1 in a deposition station 4.

As can be seen from FIG. 7 at the deposition station, a lower foil 1*a* has previously been deposited and covered by a raw board 23 which in turn is covered by another foil sheet 1*b*, the resulting stack being displaced on a belt conveyor as will be described to, for example, a laminating press. The board B can be chip board or other wood particle board and the foils 1*a* and 1*b* can be preprinted, decorative or merely protective foils.

At the stack station 3, a plurality of foil stacks 2 can be provided at predetermined distances one above the other and in the embodiments shown, two such stacks are provided. Each stack 2 can be provided on a shelf 2*a* which is vertically adjustably mounted on a stationary rack or frame 3*a* . Between the stack station 3 and the deposition station 4, at least one suction beam 5 is provided to remove an individual sheet from a respective stack and draw that sheet onto a transfer platform 6 from which that sheet can then be deposited on the station 4.

The suction beam 5 can be swung to positioning above the uppermost foil sheet 1 in either of the two stacks. Between the stack station 3 and the deposition station 4, the transfer platform 6 is provided. The transfer platform thus comprises a pair of guide rails 7 along the opposite flanks of the platform and carrying synchronously operating suction beam drives 8 for displacing suction beam 5 back and forth across platform 6. The platform 6, the guide rail 7, the suction beam drives 8 and the suction beam 5 itself form an assembly 5–8, referred to herein as the transfer assembly, which is swingably mounted at the pivot axis 9 adjacent the deposition station 4.

Figure 2:
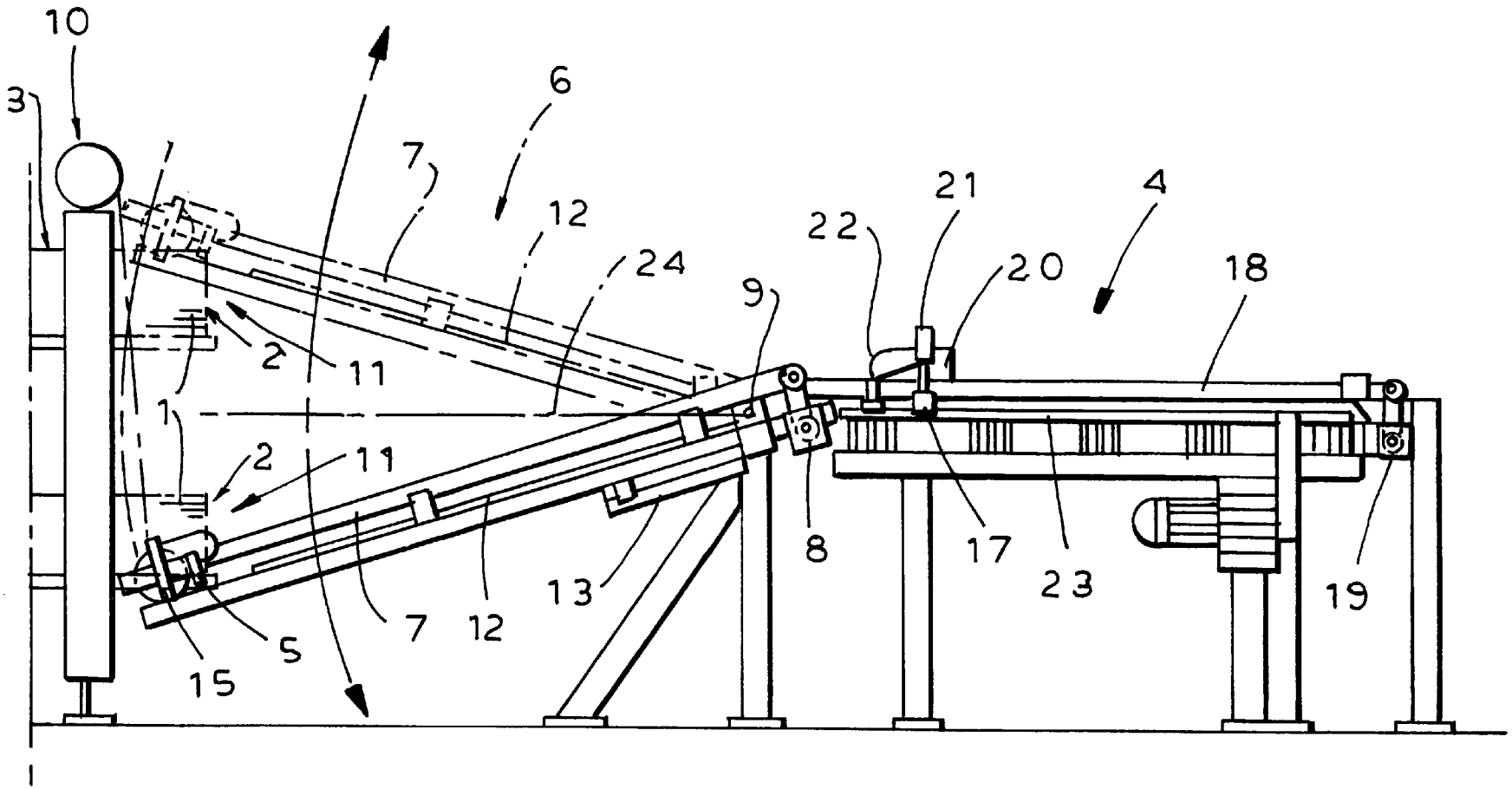
FIG. 2 is a view similar to FIG. 1 showing other positions of the transfer platform.
Figure 3:
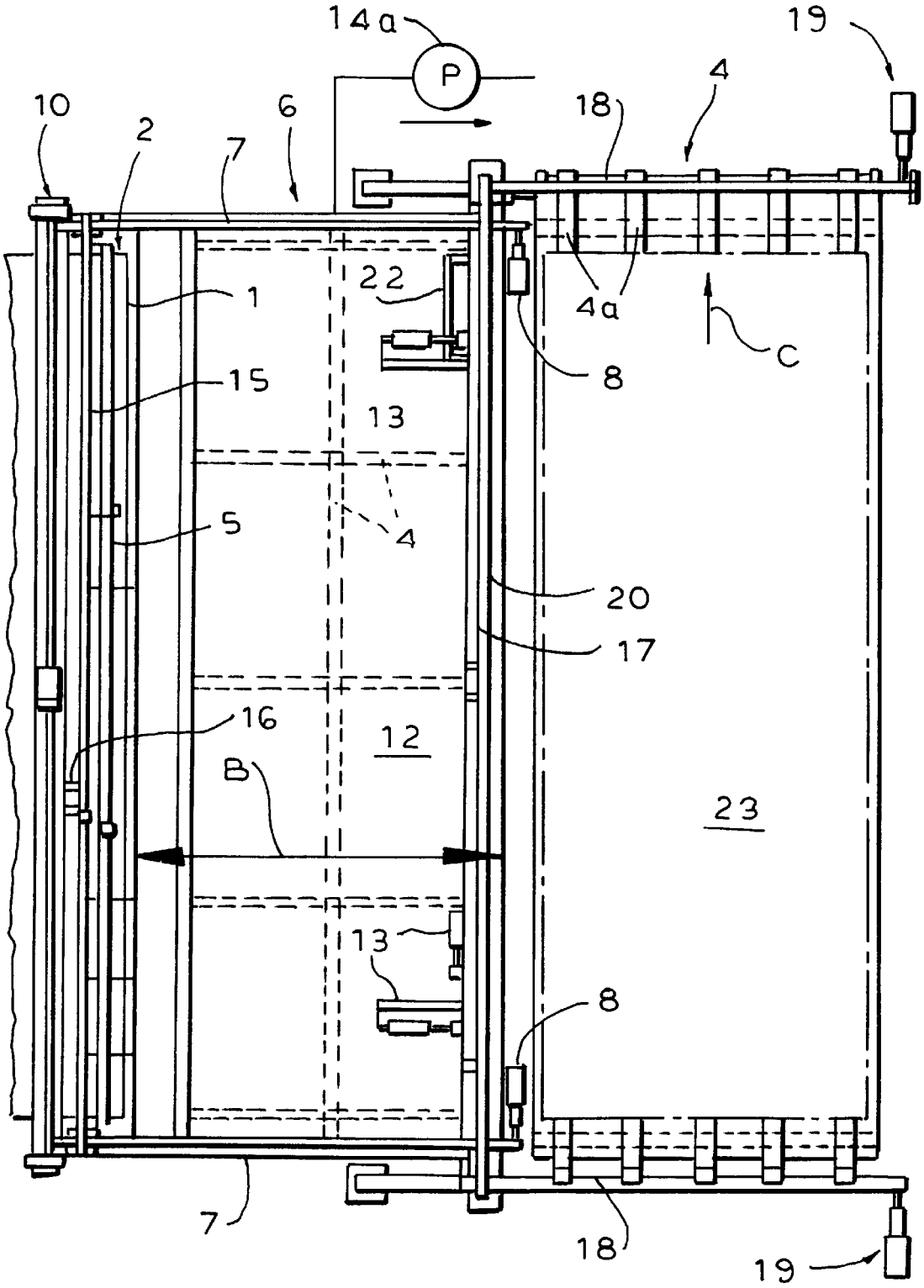
FIG. 3 is a plan view of the apparatus of FIGS. 1 and 2.
Figure 4:
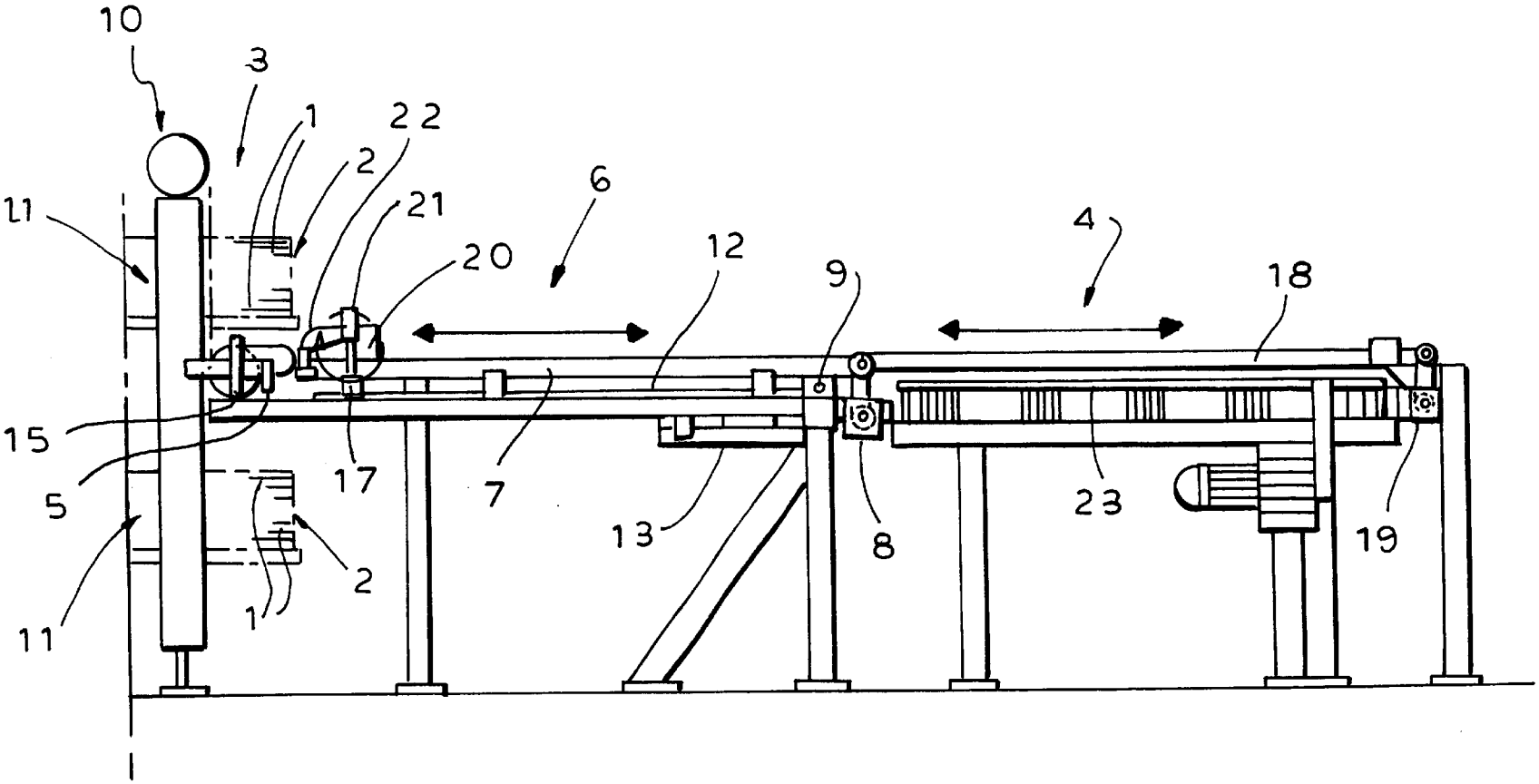
FIG. 4 is a view similar to FIG. 1 showing a second suction beam in the turning position.
Figure 5:
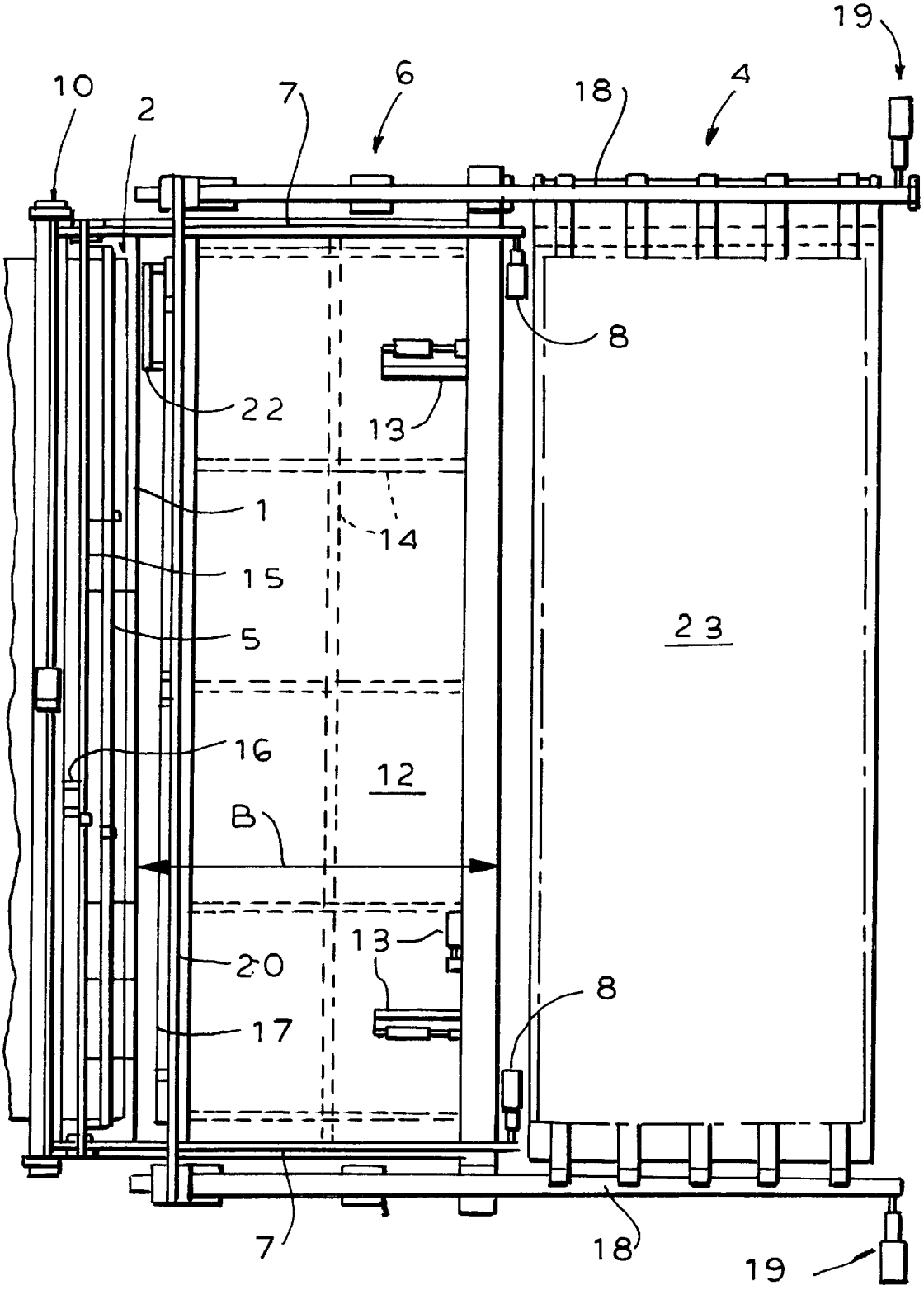
FIG. 5 is a plan view of the apparatus of FIG. 4.
Figure 6:
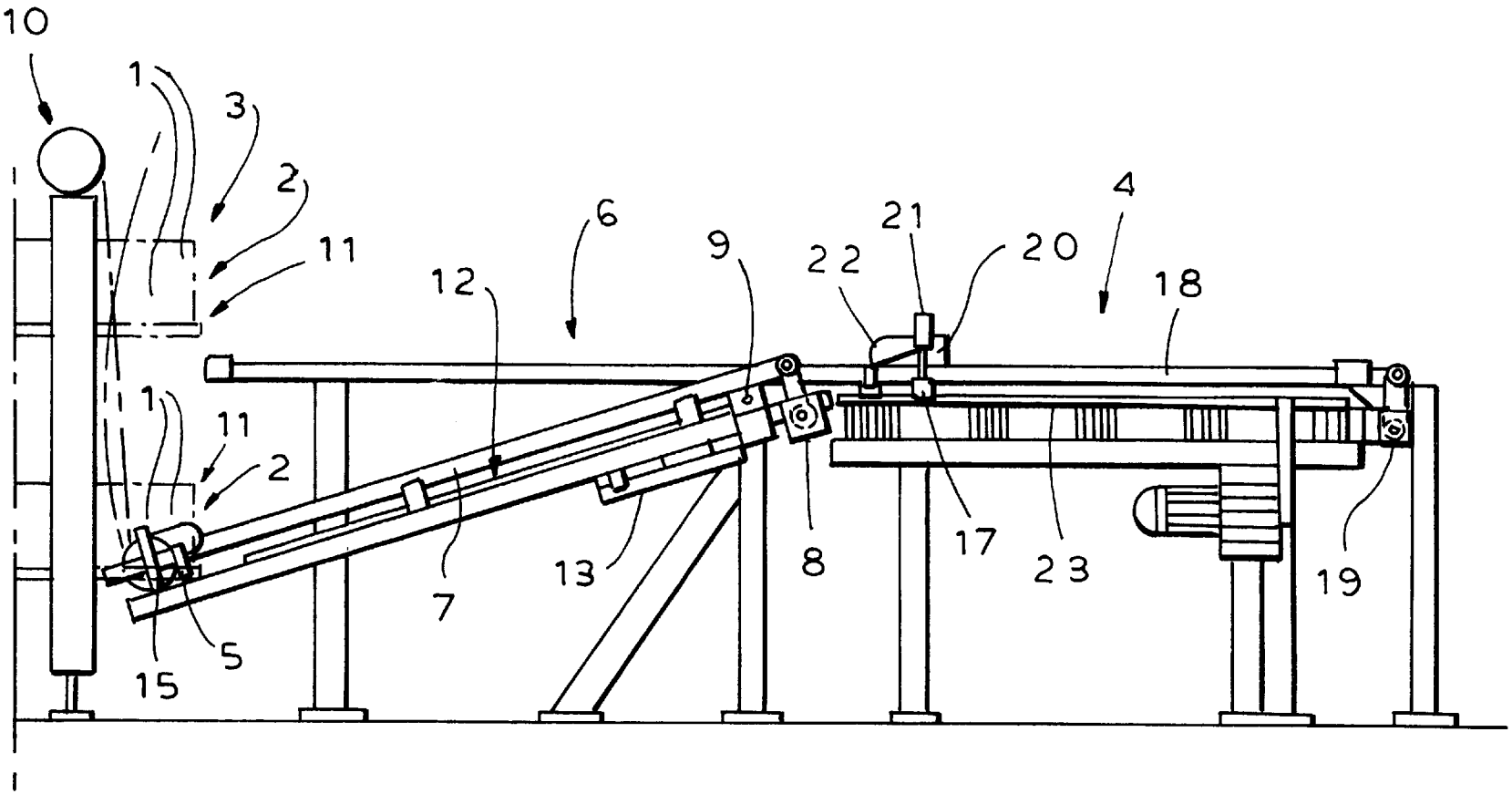
FIG. 6 is a view similar to FIG. 4 showing the second beam retracted from its position in FIG. 4.

The assembly 5–8 is connected to a swinging mechanism 10 at its side turned toward the stack station 3. The mechanism 10 can be mounted upon that station and can comprise, as shown in FIGS. 1–3, a cable system including the cables 10*a* and a windlass 10*b* for winding up or paying out the cable (compare FIGS. 1 and 2).

Alternatively, the mechanism can comprise a pair of piston-and-cylinder arrangements 10' which are pivotally connected at 10*a* to the framework 3' of the stack station and at 10*b'* to the assembly 5–8. The two cylinders on opposite sides of the assembly can be synchronously operated (see FIG. 10).

The stacking station 3 can have any desired rack system, indicted generally at 11, to receive the foil stacks 2.

The transfer platform 6 is provided with an alignment table 12 (see FIG. 3) which is swingable in the table plane in all directions and can be rotatable as desired. Representing the means for positioning the table 12 are the setting units 13 which can be piston-and-cylinder servos which are affixed to table 12 and are connected to the platform 6. The servomechanisms 13 can be operated by sensors represented diagrammatically at 13*a*, e.g. light curtains and the like, capable of detecting the edges of the foil sheets and connected to a computer 13*b*, one output of which can be connected to each of the setting servos 13 as illustrated diagrammatically in FIG. 1. The sensors and light curtains 13*a*, etc. are fixed on the platform 6 by means not shown.

In general, these sensors can detect one or more edges of each foil and provide computer control for regulation of the servomechanisms and the mechanism 8 for displacing the beam 5 and, as may be required, the second beam to be described below.

The table 12 has integrated therein suction passages 14 which can be connected to a suction source 14*a*, and intended to hold the foil in place on the table so that it can be positively positioned by the table movement on the platform.

The suction beam 5 can also be connected to the suction source 14*a* and is pivotally mounted on a traverse 15 bridged across guide rails 7. A servo unit 16 can angularly displace the suction beam 5 on the traverse 15 so that the angular position of the suction orifices on the suction beam can be varied (see the description below of FIGS. 8 and 9). The suction beam 5 is displaceable via the drives 8 which can act on beam slides and can be electric motors. While rotary motors have been shown at 8 in FIG. 3, it will be understood that linear motors can be used if desired.

The deposition station 4 has a second suction beam 17 which can be displaced on respective guide rails 18 at least part of the way across the transfer platform 6 so that it can pick up a foil 1 deposited by the suction beam 5 on the transfer platform and carry that foil onto the deposition station 4. The guide rails 18 can be provided with drives 19 for the suction beam 17 and are parallel to the guide rail 7 outwardly thereof, these rails extending the full width of the deposition station.

Like the first suction beam 5, the second suction beam 17 is carried by a traverse 20 angularly displaced by a servomechanism 21 so that, as can be seen from FIG. 8, the suction nubs 17*a* with the orifices 17*b* of the suction beam 17 can be turned downwardly to engage foil 1. The suction beam 17 can then be rotated through 180° (FIG. 9) to swing the orifices 17*b* and the suction nubs 17 into upper positions.

The suction beam 17 is associated with an electrostatic charging device represented diagrammatically at 22 and connected to a high-voltage source for applying an electrostatic charge to the foil 1. The electrostatic charging device 22 is displaceable with the beam 17 across the entire width of the deposition station 4 to the leading station end in the transport or destacking direction (arrow A in FIG. 1).

The deposition station 4 is provided as a belt conveyor with a plurality of conveyor belts 4*a* driven in a direction C orthogonal to the direction A and for carrying off the stack to the laminating press. The stack can consist of the raw board 23, e.g. a chip board or fiber board or other board composed of wood material, having a foil 1*a* and/or 1*b* on one or both sides thereof. The displaceability of the first and second suction beams 5, 17 have been shown by double-headed arrows while the swingability of the assembly has been represented by the arcuate arrow in FIG. 2. The axis 9 is located in a median horizontal plane 24 between the stacks 2.

We claim:

1. An apparatus for destacking foil sheets, comprising:

a stack station provided with means for holding at least one stack of foil sheets;

a deposition station, horizontally spaced from the stack station and provided with holding means for receiving foil sheets;

a transfer station between said stack station and said deposition station, said transfer station comprising:

a transfer platform extending between said deposition station and said stack station, a pair of guide rails disposed on opposite sides of said transfer platform, a suction beam extending between said guide rails and displaceable thereon back and forth between said stack station and said deposition station for withdrawing a foil sheet from said stack onto said transfer platform and along said transfer platform to said deposition station, means forming a pivot axis for said transfer platform, said guide rails and said suction beam at a downstream side of said transfer station and at a side of said deposition station adjoining said transfer station for enabling upward and downward swinging of an upstream side of said transfer station relative to said stacking station and relative vertical displacement of said suction beam and said holding means, said holding means being provided as two holding means at said stack station and each of said holding means being in vertically spaced relationship, each receiving a respective stack of foil sheets, said upstream side of said transfer station being swingable about said axis to position said suction beam selectively at either of said stacks, said axis being located in a horizontal plane substantially midway between the two holding means; and a swinging mechanism at said stack station operatively connected to said upstream side of said transfer station for swinging said transfer platform, said guide rails and said suction beam about said axis to position said suction beam selectively at either of said stacks, said transfer platform being formed with a rotatable alignment table pivotable in all directions in a plane of the table.

2. The apparatus defined in claim 1 wherein said table is provided with at least one pair of positioning units at an angle to one another and a means for rotating said table.

3. The apparatus defined in claim 2 wherein said table is provided with sensor means for detecting at least one of the following: edges of the foil sheets, alignment markings thereof and print contrasts thereon; said sensor means being connected with control units for said positioning units and said means for rotating.

4. The apparatus defined in claim 1 wherein said table has suction passages integrated therein and connected to a suction source.

5. The apparatus defined in claim 1 wherein said swinging mechanism includes synchronously operating piston-and-cylinder units on opposite sides of said transfer station at said upstream side.

6. The apparatus defined in claim 1 wherein said swinging mechanism includes a pull unit on said stack station and connected to said transfer station at said upstream side.

7. The apparatus defined in claim 1 wherein said stack station comprises an upright rack having support shelves for said stacks at a predetermined vertical separation between said stacks.

8. The apparatus defined in claim 1, further comprising a traverse connected to and spanning said guide rails, said suction beams being mounted on said traverse and provided with a setting unit for setting an angular position of said beam.

9. The apparatus defined in claim 1 wherein said suction beam is mounted in guide carriages on the guide rail and the guide carriages are driven by linear electric motors.

10. An apparatus for destacking foil sheets, comprising:

a stack station provided with means for holding at least one stack of foil sheets;

a deposition station having a given width horizontally spaced from the stack station and provided with holding means for receiving foil sheets;

a transfer station between said stack station and said deposition station, said transfer station comprising;

a transfer platform extending between said deposition station and said stack station, a pair of guide rails disposed on opposite sides of said transfer platform, a suction beam extending between said guide rails and displaceable thereon back and forth between said stack station and said deposition station for withdrawing a foil sheet from said stack onto said transfer platform and along said transfer platform to said deposition station, means forming a pivot axis for said transfer platform, said guide rails and said suction beam at a downstream side of said transfer station and at a side of said deposition station adjoining said transfer station for enabling upward and downward swinging of an upstream side of said transfer station relative to said stacking station and relative vertical displacement of said suction beam and said holding means, said holding means being provided as two holding means at said stack station and each of said holding means being in vertically spaced relationship, each receiving a respective stack of foil sheets, said upstream side of said transfer station being swingable about said axis to position said suction beam selectively at either of said stacks, said axis being located in a horizontal plane substantially midway between the two holding means; and a swinging mechanism at said stack station operatively connected to said upstream side of said transfer station for swinging said transfer platform, said guide rails and said suction beam about said axis to position said suction beam selectively at either of said stacks, said deposition station is provided with a suction bar displaceable at least partly over said platform for picking up a foil sheet deposited by the suction beam and which is displaceable over the width of said deposition station to deposit the picked-up foil sheet on the deposition station.

11. The apparatus defined in claim 10 wherein the suction bar is provided with guide rails displaceable parallel to the guide rails of the suction beam and formed with respective drives for the suction bar, the guide rails for said second suction beam extending over at least part of the width of said transfer platform and toward said stack station.

12. The apparatus defined in claim 11 wherein said suction bar is mounted upon a traverse connecting respective guide rails and is swingable thereon via a respective setting unit.

13. The apparatus defined in claim 11 wherein a telescoping guide is provided for at least one of said suction beams.

14. The apparatus defined in claim 11 wherein said second suction beam is provided with means for vertically displacing the second suction beam.

15. The apparatus defined in claim 11 wherein said second suction beam is provided with an electrostatic charging device displaceable over a leading end of the deposition station with respect to the direction of displacement of the foil sheets from said stack station.

16. An apparatus for destacking foil sheets, comprising:

a stack station provided with means for holding at least one stack of foil sheets;

a deposition station horizontally spaced from the stack station and provided with holding means for receiving foil sheets;

a transfer station between said stack station and said deposition station, said transfer station comprising:

a transfer platform extending between said deposition station and said stack station, a pair of guide rails disposed on opposite sides of said transfer platform, a suction beam extending between said guide rails and displaceable thereon back and forth between said stack station and said deposition station for withdrawing a foil sheet from said stack onto said transfer platform and along said transfer platform to said deposition station, means forming a pivot axis for said transfer platform, said guide rails and said suction beam at a downstream side of said transfer station and at a side of said deposition station adjoining said transfer station for enabling upward and downward swinging of an upstream side of said transfer station relative to said stacking station and relative vertical displacement of said suction beam and said holding means, said holding means being provided as two holding means at said stack station and each of said holding means being in vertically spaced relationship, each receiving a respective stack of foil sheets, said upstream side of said transfer station being swingable about said axis to position said suction beam selectively at either of said stacks at said stack station, said axis being located in a horizontal plane substantially midway between the two holding means; and a swinging mechanism at said stack station operatively connected to said upstream side of said transfer station for swinging said transfer platform, said guide rails and said suction beam about said axis to position said suction beam selectively at either of said stacks at said stack station, said deposition station being provided with a belt conveyor for carrying off a stack formed by at least one foil sheet and another member forming a charge for a press in a direction orthogonal to a direction of displacement of said foil sheet into said deposition station.

* * * * *